US010046188B2

(12) United States Patent
Rousseau et al.

(10) Patent No.: US 10,046,188 B2
(45) **Date of Patent: *Aug. 14, 2018**

(54) SELF-FLUFFING VEHICLE FIRE EXTINGUISHER

(71) Applicants: Randy Rousseau, Riverside, CA (US); Hector Rousseau, Riverside, CA (US)

(72) Inventors: Randy Rousseau, Riverside, CA (US); Hector Rousseau, Riverside, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/143,813

(22) Filed: May 2, 2016

(65) Prior Publication Data

US 2016/0243385 A1 Aug. 25, 2016

Related U.S. Application Data

(63) Continuation-in-part of application No. 14/745,135, filed on Jun. 19, 2015, which is a continuation-in-part of application No. 12/851,169, filed on Aug. 5, 2010, now Pat. No. 8,757,282, which is a continuation-in-part of application No. 11/578,494, filed as application No. PCT/US2006/041157 on Oct. 12, 2006, now Pat. No. 7,793,737, which is a continuation-in-part of application No. 11/226,815, filed on Nov. 4, 2005, now Pat. No. 7,128,163, and a (Continued)

(51) Int. Cl.

| | |
|---|---|
| ***A62C 13/00*** | (2006.01) |
| ***A62C 3/07*** | (2006.01) |
| ***A62C 13/66*** | (2006.01) |
| ***A62C 13/76*** | (2006.01) |
| ***A62C 37/50*** | (2006.01) |
| *A62C 13/74* | (2006.01) |

(52) U.S. Cl.

CPC ..... *A62C 3/07* (2013.01); *A62C 13/006* (2013.01); *A62C 13/66* (2013.01); *A62C 13/76* (2013.01); *A62C 37/50* (2013.01); *A62C 13/74* (2013.01)

(58) Field of Classification Search

CPC ..... A62C 3/07; A62C 13/006; A62C 13/66; A62C 13/74; A62C 13/76; A62C 13/78; A62C 37/50; A62C 13/00

USPC ..... 169/51

See application file for complete search history.

(56) References Cited

U.S. PATENT DOCUMENTS 674,827 A 5/1901 Edmands
907,029 A 12/1908 Giseke (Continued)

FOREIGN PATENT DOCUMENTS

GB 447936 5/1936

*Primary Examiner* — Jason Boeckmann

(74) *Attorney, Agent, or Firm* — Kirk A. Buhler; Buhler & Associates

(57) ABSTRACT

Improvements to a self-fluffing vehicle fire extinguisher where the improvements relate to a system where the extinguisher can be monitored and maintained. Further Improvements include an anti-bridging mechanism that is articulated from the exterior of the chamber to fluff, mix or stir the powder within the chamber to keep it in a liquefied state. An automatic fluffing motor and manual fluffing wheel. Pressurizing the fire extinguisher can be with an external gas chamber or can be with a compressor that maintains the pressure within the extinguisher. A delivery system can direct the fire extinguishing media to an area of the vehicle that has an elevated temperature or can distribute the media thorough the occupied or unoccupied portion of the vehicle.

9 Claims, 3 Drawing Sheets

Related U.S. Application Data continuation-in-part of application No. 11/515,471, filed on Sep. 1, 2006, now Pat. No. 7,318,484.

(56) References Cited

U.S. PATENT DOCUMENTS

| | | | | | |
|---|---|---|---|---|---|
| 1,272,012 | A | | 7/1918 | Connor | |
| 1,354,093 | A | | 9/1920 | Davidson | |
| 1,733,724 | A | | 10/1929 | Downs | |
| 1,790,231 | A | | 1/1931 | Dugas | |
| 1,980,051 | A | | 11/1934 | Graham et al. | |
| 2,017,319 | A | | 10/1935 | McMullen | |
| 2,067,829 | A | | 1/1937 | Dennel | |
| 2,430,470 | A | | 11/1947 | Keefe, Jr. | |
| 2,489,339 | A | | 11/1949 | Stroop | |
| 2,541,554 | A | | 2/1951 | Smith | |
| 2,569,975 | A | | 10/1951 | Cone | |
| 2,592,029 | A | | 4/1952 | Hansen | |
| 2,785,759 | A | | 3/1957 | Fleming et al. | |
| 3,149,677 | A | | 9/1964 | Blair | |
| 3,255,824 | A | | 6/1966 | Rodgers | |
| 3,618,669 | A | | 11/1971 | Sachs | |
| 3,713,493 | A | | 1/1973 | Hansen | |
| 3,719,232 | A | | 3/1973 | Gubela | |
| 3,754,602 | A | | 8/1973 | Magdars | |
| 3,858,659 | A | * | 1/1975 | Fukushima | A62C 13/70 169/77 |
| 3,889,752 | A | | 6/1975 | Dunn | |
| 3,972,373 | A | | 8/1976 | Nichols et al. | |
| 4,372,394 | A | * | 2/1983 | Allegri, Sr. | A62C 13/76 169/30 |
| 4,423,784 | A | | 1/1984 | Bolen | |
| 4,497,580 | A | * | 2/1985 | Doyel | B01F 7/1695 222/239 |
| 4,505,336 | A | | 3/1985 | Thevis et al. | |
| 4,567,948 | A | | 2/1986 | Roznieck | |
| 4,650,004 | A | | 3/1987 | Wendling et al. | |
| 4,862,968 | A | | 9/1989 | Woodman | |
| 4,982,798 | A | | 1/1991 | Wang | |
| 4,986,365 | A | | 1/1991 | Shieh | |
| 5,119,878 | A | | 6/1992 | Lee | |
| 5,590,718 | A | | 1/1997 | Bertossi | |
| 5,613,564 | A | * | 3/1997 | Rhines | A62C 3/07 169/61 |
| 5,727,635 | A | | 3/1998 | Doty et al. | |
| 5,960,888 | A | | 10/1999 | Moore, Sr. | |
| 6,189,624 | B1 | | 2/2001 | James | |
| 6,378,740 | B1 | | 4/2002 | Martin | |
| 6,527,058 | B1 | | 3/2003 | Nerat | |
| 7,128,163 | B1 | * | 10/2006 | Rousseau | A62C 13/66 169/30 |
| 7,650,948 | B2 | * | 1/2010 | Rousseau | A62C 13/70 169/23 |
| 7,793,737 | B2 | * | 9/2010 | Rouosseau | 169/30 |
| 9,132,304 | B1 | | 9/2015 | Griffin, Sr. et al. | |
| 2003/0116329 | A1 | | 6/2003 | McSheffrey, Jr. et al. | |
| 2004/0070506 | A1 | | 4/2004 | Runyon et al. | |
| 2004/0166266 | A1 | | 8/2004 | De Wit | |
| 2005/0006109 | A1 | | 1/2005 | McSheffrey et al. | |
| 2005/0060953 | A1 | | 3/2005 | Altonen et al. | |
| 2005/0269110 | A1 | | 12/2005 | McSheffrey, Jr. et al. | |
| 2006/0283608 | A1 | | 12/2006 | Hauck | |
| 2008/0143539 | A1 | | 6/2008 | McSheffrey et al. | |
| 2009/0237239 | A1 | | 9/2009 | McSheffrey | |
| 2009/0301739 | A1 | | 12/2009 | Rother et al. | |
| 2011/0241873 | A1 | | 10/2011 | McSheffrey et al. | |
| 2012/0119917 | A1 | | 5/2012 | McSheffrey et al. | |
| 2013/0088349 | A1 | | 4/2013 | McSheffrey, Sr. et al. | |

* cited by examiner

SELF-FLUFFING VEHICLE FIRE EXTINGUISHER

CROSS REFERENCE TO RELATED APPLICATION

This application is a continuation-in-part of applicant's co-pending application Ser. No. 14/745,135 filed on Sep. 8, 2014 which is a continuation-in-part of application Ser. No. 12/851,169 filed on Aug. 5, 2010 that issued as U.S. Pat. No. 8,757,282 on Jun. 24, 2014 which is a continuation-in-part of application Ser. No. 11/578,494 that was filed on Oct. 12, 2006 which issued as U.S. Pat. No. 7,793,737 on Sep. 14, 2010, which claims priority to international application PCT/US06/41157 that was filed on Oct. 12, 2006 which claims priority to application Ser. No. 11/515,471 that was filed on Sep. 1, 2006 and issued as U.S. Pat. No. 7,318,484 on Jan. 1, 2015 and application Ser. No. 11/226,815 that was filed on Nov. 4, 2005 and issued as U.S. Pat. No. 7,128,163 on Nov. 31, 2006.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in self-fluffing vehicle fire extinguisher delivery system. More particularly, the present invention relates to a fire extinguisher that allows for external mixing, fluffing, actuating or stirring of the powder within the chamber to provide anti-bridging of the powder to keep it in a liquefied state. Because the extinguisher is mounting in a vehicle, the electrical system of the vehicle can power the fluffing mechanism.

Description of Related Art Including Information Disclosed Under 37 CFR 1.97 and 1.98

Most portable fire extinguishers are of a similar design where the fire extinguishing powder is contained in a pressurized chamber. Fire extinguishers of this type require scheduled maintenance because the powder within the chamber can settle and cake preventing it from being dispensed when needed. The pressure within the chamber may also leak over time and be insufficient to propel the powder out of the dispensing nozzle. A further limitation, based upon this design is due to the pressurized condition of the chamber, powder is placed into the chamber in a small opening in the top of the extinguisher. This scheduled maintenance allow moisture intrusion causing caking. Current extinguishers can only be service by trained certified technicians, and the certification is issued by the fire marshal for each state. The current fire system in place today requires the services of a third party. The service companies (third parties) are charged with maintaining the system. They cannot in fact meet the standards required of them. They cannot meet the requirements of the UL label. Nor can they meet the manufacturer's requirements.

UL states each extinguisher must be maintained in the same manner as it was tested. The powder must be the manufacturer's powder. The lubricants must be the same manufacturer's brand. The hanger must be of the same manufacturer. If these requirements are not met the UL listing is voided and the extinguishers must be recalled. It is impossible for any service company to meet these requirements. All service firms perform the maintenance of the extinguishers in service vehicles. These vehicles are small vans or pick-up trucks. They can carry at most two recovery systems, one for ABC and one for BC. There are no service vehicles capable of carrying a recovery system for each brand of extinguisher as required by UL. All extinguishers in service today have contaminated powder and the UL has been voided. This also speaks to the lubricants and parts as well.

The manufacturer and NFPA-10 standards also impose standards that cannot be met by the service firms. The manufacturers require that only their powder, parts and lubricants must be used in their products. They also require standard for the servicing of the same. The concern for the environmental impact on their powder i.e. the humidity level, the amount of air the powder is exposed too, the mixing of powder. The manufacturers produce their product in a controlled environment and as such can protect against caking and maintaining a fluid effect with their powder. The current extinguishers use chemical recycled thru a recovery system thus the mixing of chemicals. This extinguisher has the only enclosed chemical cartridge and no mixing of the chemical can take place.

Mixing the powder and using their own brand of lubricants and parts they allow an abundance of air in various stages to compromise the powder. Currently the only prevention for this is to never open the extinguisher and to return it to the manufacturer when it is required to be hydro tested or to have the six-year tear down to clear the powder. It is commonly understood that because the current system is made up of pressurized portable fire extinguishers resulting in the compaction of the powder and therefore must be fluffed. The current system is plagued with serious problems. The service firms have very little supervision and are in a position to abuse the public. Most enforcement officers are charged with other more serious duties, i.e. arson etc. and has little time to dedicate to a system that is in fact impossible to maintain. The vast majorities of service firms operate out of the back of their trucks and are continually on the move, making them difficult to locate and to implement any type of enforcement.

Current extinguishers are open to wear and tear because of the constant pressure and the tear down process. When serviced they are fired into a recycling chamber and all the parts must be disassembled and cleaned. All the pressure rings must be replaced and every part must them be reassembled with new powder being placed within the chamber prior to pressurizing the chamber. The servicing of current fire extinguishers often creates more wear and tear on the fire extinguisher than when it is used to extinguish a fire.

U.S. Pat. No. 6,189,624 issued to James on Feb. 20, 2001 and Japan Patent Number JP9,225,056 issued to Yamazaki Tomoki on Sep. 2, 1997 disclose fire extinguishing mechanisms where the chamber is not continuously pressurized, and the pressurized chamber is a separate entity integrated within the chamber. While these patents disclose a separate pressurized canister, the canister is not located in a position that is easy to service, replace, or inspect. This minimizes the ability determine the charge level of the $CO_2$ cartridge.

U.S. Pat. No. 2,541,554 issued to C H Smith on Feb. 13 1951 and Russian Patent Number RU 2,209,101 issued to Glavatski G. D. Et Al. Nov. 2, 2002 discloses a fire extinguisher with external $CO_2$ gas cartridge. In the case U.S. Pat. No. '554 the $CO_2$ gas cartridge sits on top of the fire extinguisher chamber and is not integrated within the handle of the fire extinguisher. In the case of RU '101 the $CO_2$ gas cartridge is external to the extinguisher and is connected to the extinguisher with a pipe or hose. While both of these patents disclose a $CO_2$ cartridge that is external to the chamber, neither of them is placed in the handle to allow a configuration of the fire extinguisher that is simple to inspect and replace.

Russian Patent Number RU2,209,101 issued to Glavatski G. D. Et Al. Nov. 2, 2002 discloses a fire extinguisher with an internal fluffing mechanism consisting of a coiled spring. It is known that one of the problems with powder type fire extinguishers is the possibility that the extinguishing powder within the chamber can cake and harden if it is not fluffed to keep the powder in liquid configuration. While the RU '101 patent discloses a fluffing mechanism, the fluffing mechanism is operated by a wound spring, and one the spring has been used there is no mechanism to wind the spring. The proposed product does not have this limitation because it provides an external mechanical interface that allows a user to manually fluff the powered.

Due to the pressurized condition that exists with pressurized fire extinguishers, the opening where powder is placed into the extinguisher is limited due to the structural requirement to maintain pressure within the chamber at all times. The proposed application eliminates this need by providing an external pressurized gas cartridge, thus allowing the chamber to exist in a normally un-pressurized condition. Because the chamber is not under pressure the top opening of the extinguisher can be enlarged to allow easier filling of the fire extinguisher with powder, or checking the amount and or condition of the powder within the chamber. This extinguisher does not require this testing, it is not pressurized constantly, only when it is needed to extinguish a fire and then it only holds pressure for the maximum of a minute.

U.S. Pat. No. 1,272,012 issued on Jul. 9, 1918 to M. N. Connor and discloses a vehicle with a tank having a handle for agitating the fluid in the tank. This patent requires a person to manually turn the crank to mix fluid, prior or during dispensing the fluid onto a fire.

A number of patents have been issued that include an audible alarm to indicate that a fire extinguisher has been moved or taken. Exemplary examples of these patents include U.S. Pat. No. 4,360,802 issued to Anthony A. Pinto on Nov. 23, 1982, U.S. Pat. No. 4,592,301 issued to Anthony J. Monte on Jun. 3, 1986 and U.S. Pat. No. 3,893,095 issued to Dennis E. DeJong on Jul. 1, 1975. While these patents disclose a signaling means to announce that the fire extinguisher has been removed, none of them disclose a wireless indicator, or due they provide for a mixing mechanism for fluffing the internal contents of the fire extinguisher.

What is needed is a fire extinguisher with an external gas cartridge where the gas cartridge is located with the extinguisher or the vehicle operates a compressor. The proposed self-fluffing vehicle fire extinguisher provides this solution by providing a fire extinguisher that is self-maintained in a ready condition to extinguish a fire in or around a vehicle.

BRIEF SUMMARY OF THE INVENTION

It is an object of the self-fluffing vehicle fire extinguisher to provide a fire extinguisher with an external pressurized canister. The external canister allows the chamber to exist at or near ambient pressure that reduces the need to utilize a high strength chamber. The standard pressurized cartridge that is used in other applications can be easily adapted Lu operate with the fire extinguisher. Since the pressurized cartridge is external to the chamber it can be easily replaced or swapped without replacing the entire fire extinguisher.

It is an object of the self-fluffing vehicle fire extinguisher to have a compressor that is connected to the extinguisher with a one-way valve. The pressure inside the extinguisher can be monitored, and if the pressure is too low, the compressor can be automatically operated to increase the pressure in the extinguisher. Most fire extinguishers are pressurized at 195 PSI.

It is an object of the self-fluffing vehicle fire extinguisher to provide a fire extinguisher with an externally accessible fluffing mechanism. The externally accessible fluffing mechanism promotes anti-bridging of the powder within the chamber to keep it fluffed, agitated, stirred or disturbed to prevent caking of the powder and keep the powder in a liquefied state so it is easier to spray the powder onto a fire. The fluffing is accomplished with paddles, flapper, chains rods or other mixing mechanisms located within the chamber. The mixing mechanism is accessed by a connection on the top, bottom or side of the chamber and can be either manually operated or operated with a key of some type.

It is an object of the self-fluffing vehicle fire extinguisher for the fluffing mechanism to be intermittently operated by a motor. The motor can fluff the internal chamber at preset intervals, when the vehicle is started, when the vehicle is stopped or when the extinguisher has been activated. A timing device can be used to fluff the contents at pre-defined intervals, or the mixing can be performed continuously at a pre-defined rate of rotation.

It is still another object of the self-fluffing vehicle fire extinguisher for the extinguisher to have a fluffing wheel that can be operated by hand or powdered. The wheel is attached at the base of the extinguisher. The fluffing wheel is snapped on to the internal agitator. It is easily activated and if the operator finds the wheel difficult to turn the entire powder cartridge should be replaced.

It is still another object of the self-fluffing vehicle fire extinguisher to include a delivery system that can direct the fire extinguishing media to an area of the vehicle that has an elevated temperature or can distribute the media thorough the occupied or unoccupied portion of the vehicle Various objects, features, aspects, and advantages of the self-fluffing vehicle fire extinguisher will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
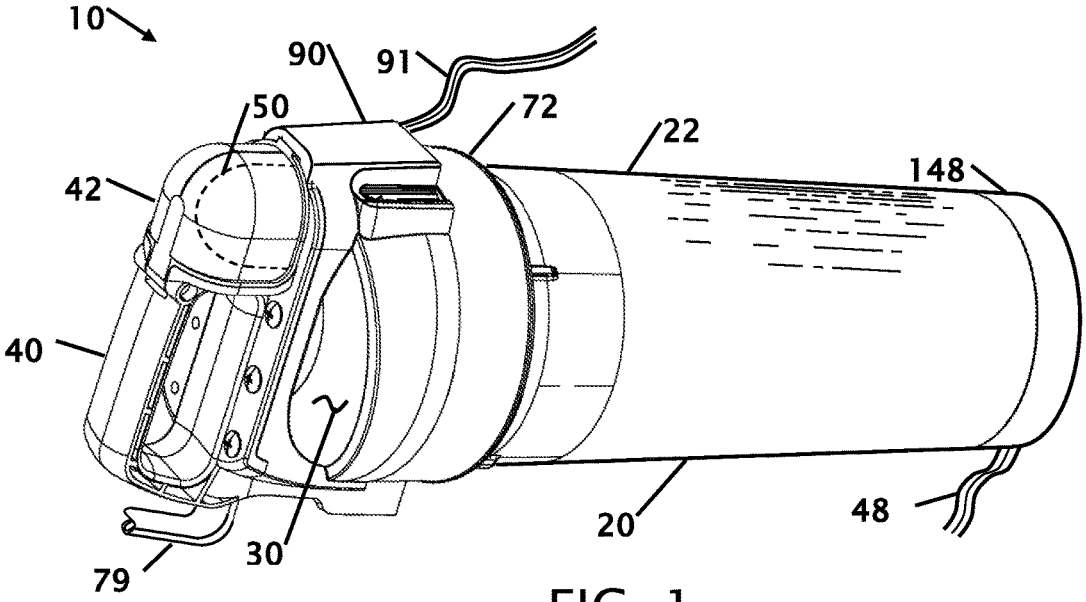
FIG. 1 shows an isometric view of the vehicle fire extinguisher.

FIG. 1 an isometric view of the self-reliant fire extinguisher 10. The chamber 20 is substantially a cylindrical shape with a bottom 22 and a top 30 housing. In the preferred embodiment the chamber is molded from a lightweight resilient material, but it is further contemplated that the chamber be made of aluminum, steel, brass or copper. The preferred embodiment of plastics allows the extinguisher to be placed in locations that could cause corrosion of metals. The top 30 is screwed onto the chamber, but it could also be attached with a bayonet or latching mechanism. The top 30 fits on top of an enlarged opening 72 on the chamber to allow easier filling of the chamber 20 with fire retardant materials. A wall hanging mechanism can be incorporated into the top of the extinguisher, wrap around the body of the cylinder or fork the top of the extinguisher. An optional handle 40 allows the operator to hold the extinguisher in an upright or horizontal orientation. The fire extinguisher can also be stored and or transported in the upright orientation. Within the handle 40 a pressurized canister 50 is located, but a compressor can also be connected to the chamber. While in the preferred embodiment the pressurized canister is shown within the handle other locations such as within the top of the extinguisher or adjacent to the hose are contemplated.

The canister 50 consists essentially of a pressurized chamber, but canisters of different types of gas are possible that do not promote spreading of the fire. Because the gas within the canister is under high pressure or in a liquid state, a small canister of pressurized gas is required to expel the contents of the chamber 20. It is also contemplated that multiple pressurized canisters can be placed within the handle to accommodate a larger fire extinguisher without deviating from the inventive nature of the design. Pressurized canisters are available from a variety of sources and can be replaced or serviced without the need to service the entire fire extinguisher. The handle 40 provides some protection to the canister in the event the fire extinguisher is dropped or roughly handled. A cover 42 protects the gas cartridge. The handle 40 to provide structural strength to the top of the fire extinguisher as well as providing a hole for gripping. An electronic 90 or manual trigger mechanism opens the pressurized canister to pressurize the chamber and expel the fire extinguishing media out the tube 79 into a manifold that distributes fire extinguishing media to a fire within a vehicle. The vehicle can be a car, bus, truck or other type vehicle where a fire may occur.

The location of the activation trigger the fire extinguisher provide a fire extinguisher that is designed for ease of access for right and left handed person, but can also be electrically operated when a temperature threshold is achieved. The trigger mechanism 90 can be electrically activated 91 on the fire extinguisher, or can be manually active where an operator to pressed on the extinguisher to operate the extinguisher, but other embodiments are contemplated including but not limited to a finger trigger or a slide mechanism. A safety pin may be incorporated to prevent accidental operation of the extinguisher. The extinguisher is hung or secured from a wall within the passenger compartment or can be secured within the engine or truck compartment.

The extinguisher has a powder release valve 90. The path from the pressurized canister 50 to the nozzle 90 is best shown and described in FIG. 3 herein.

Figure 2:
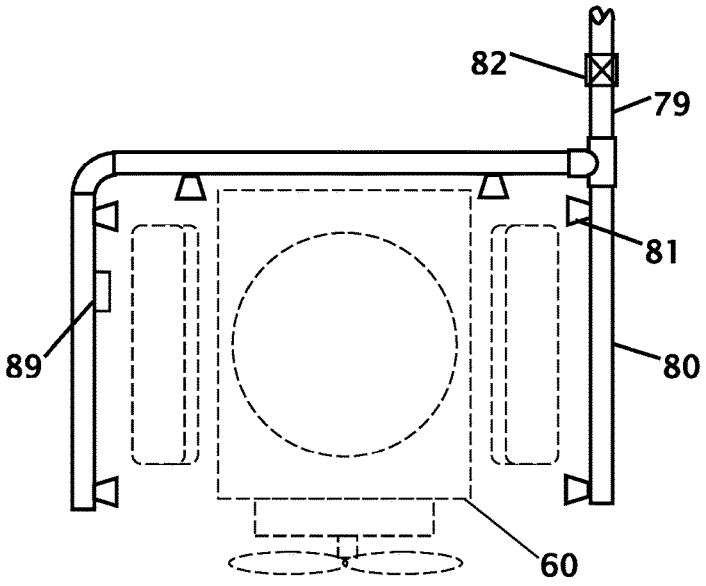
FIG. 2 shows a top view of an engine compartment with the fire distribution manifold.

FIG. 2 shows a top view of an engine compartment with the fire distribution manifold. This embodiment shows the distribution manifold in the engine 60 compartment, but the distribution can be located in other areas of the vehicle, including but not limited to, the passenger compartment, exhaust area, fuel tank and transmission. It is further contemplated that the multiple sensors 89 can be located throughout the vehicle and depending upon the area that is experiencing elevated temperatures, some or all of the fire extinguishing media can be directed to that particular area by opening a valve 82.

The manifold pipe 79 connects to the extinguisher. The pipes 80 have nozzles 81 where the fire extinguishing media is distributed to extinguish a fire. In the embodiment shown the manifold of pipes, essential wrap around the engine 60 and may also exist both above and below the engine 60 to extinguish a fire from fuel intake at the top of the engine 60 as well as from items or fuel that can fall through the engine compartment and onto the ground.

Figure 3:
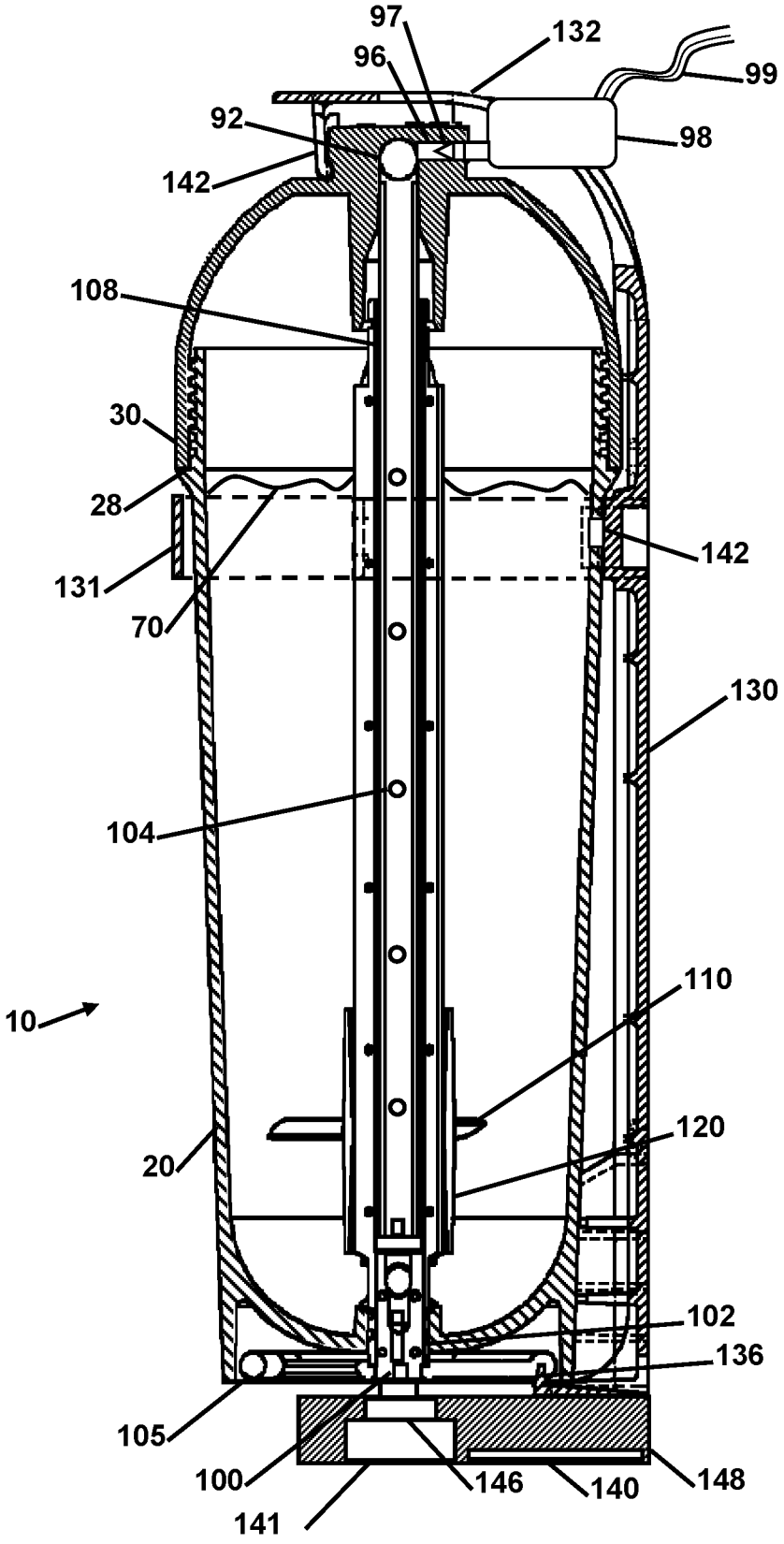
FIG. 3 shows a side sectional view of the vehicle fire extinguisher, in a bracket.

FIG. 3 shows a side sectional view of the vehicle fire extinguisher, in a bracket 130. The fluffing mechanism conditions the fire-retardant media to provide anti-bridging of the media within the chamber to agitate, fluff, turn, disturb, stir, ruffle, and or alters the condition of the media to allow the media to maintain a powder consistency. This allows the fire-retardant powder media to remain in a liquefied state so it is easier to spray the powder onto a fire. The conditioning of the media can be performed using a variety of methods and in the preferred embodiment the conditioning is performed with an appendage 110 that can be articulated from the exterior of the chamber at item 100. The appendage is a shaft that extends the length of the chamber and has a number of flaps 120 attached to the appendage. While flaps are shown and used in the preferred embodiment a variety of other appendages are contemplated that can condition the media that include but are not limited to rods, paddles, arms, disks, cable, chains or combination thereof. It is also contemplated that the appendage can be a simple hook or chain that conditions the fire extinguishing media. When the trigger is activated the pressure in canister 50 (FIG. 1) is released into the chamber and the fire suppressant medial 70 is pushed through holes 104 in the central fluffer shaft tube 108 where it is pushed out hole 92 then exiting out into the distribution manifold piping 79.

The fluffer is formed from two halves of material that is joined to create the fluffing shaft. It is contemplated that the fluffing can be accomplished by blowing gas into the chamber through a hole and through the fluffing shaft to fluff the media within the chamber where the gas blows through the shaft and out fluffing holes 104. As previously described the appendage terminates 100 at the bottom of the chamber with a drive fitting where it can be articulated, but the appendage could terminate at the top or sides of the chamber. The termination at the bottom of the chamber 100 to allow articulation that requires either a key to attach to the appendage, or may terminate with manual knob, handle, wheel or other extension. A manually rotatable handle is shown for manual fluffing of the fire extinguishing media.

Referring back to FIG. 1 the head (delivery system) has an emission port and an entry port plus a pick-up tube. A solenoid (shown in other figures herein) is wired to a control circuit activates dispensing of the fire extinguishing media. The powering cartridge 50 is easily installed in the handle 40 attached to the head of the extinguisher. The powder cartridge has a fluffer shaft tube 108 with an opening to accept the pick-up tube within the head. Current fire extinguishers must be torn down every six years to fluff the powder, check for caking and to check the condition of the chemical. This extinguisher does not have to be broken down; the powder can be fluffed each month, once a year or the chemical cartridge can simple be replaced. The current fire extinguishers have to be subjected to a hydo test every five years for fleet vehicles and every twelve years for the standard extinguishers.

In one contemplated embodiment the gas filled cartridge is replaced with a compressor 98 with a one-way check valve 97 maintains pressure within the chamber. A sensor 142 monitors the pressure within the chamber and ensures that the fire extinguisher is properly pressurized. It is contemplated that an over pressure relief valve can be incorporated within the fire extinguisher to vent any excessive pressure from within the cylinder that could cause the fire extinguisher to burst due to over pressurization of the chamber.

The mounting bracket is bracket is an elongated vertical or horizontal structure 130 depending upon space and mounting requirement. A supporting base support 133 extends from the lower portion of the elongated vertical structure 130 for supporting one end a fire extinguisher. A cover arm 132 extends from the upper portion 132 of the elongated structure to a position over at least a portion of the top of the fire extinguisher placed on the supporting base.

When the fire extinguisher is installed on the bracket a tab 136 extends vertically from the bottom support 133 and extends under the bottom housing of the fire extinguisher. Another clip 142 wraps around the extinguisher to hold the extinguisher inside the bracket. A powered fluffing mechanism 148 is shown in the bottom bracket. The mechanism shown is powered by the vehicle electrical system. A motor 141 is shown connected to a transmission 146 that is connected either directly to the bottom drive mechanism 100 of the fluffing shaft mechanism 120 or to an intermediary fluffing knob 105. A circuit board 140 is shown in FIG. 2 that provides control for an alarm, a visual indicator light 144 and control of the motor 141. The motor 141 can be activated at timed internals or can be activated when the engine is started or stopped. When the fire extinguishing media is being dispensed, the motor 141 is activated to ensure the fire extinguishing media is in an optimal condition for dispensing. While the motor 141 is shown outside of the chamber, it is also contemplated that the motor 141 could be internal to the chamber or incorporated into the chamber with an electrical connection running outside of the chamber 20 to turn the motor and therefore articulate the appendages 110.

Figure 4:
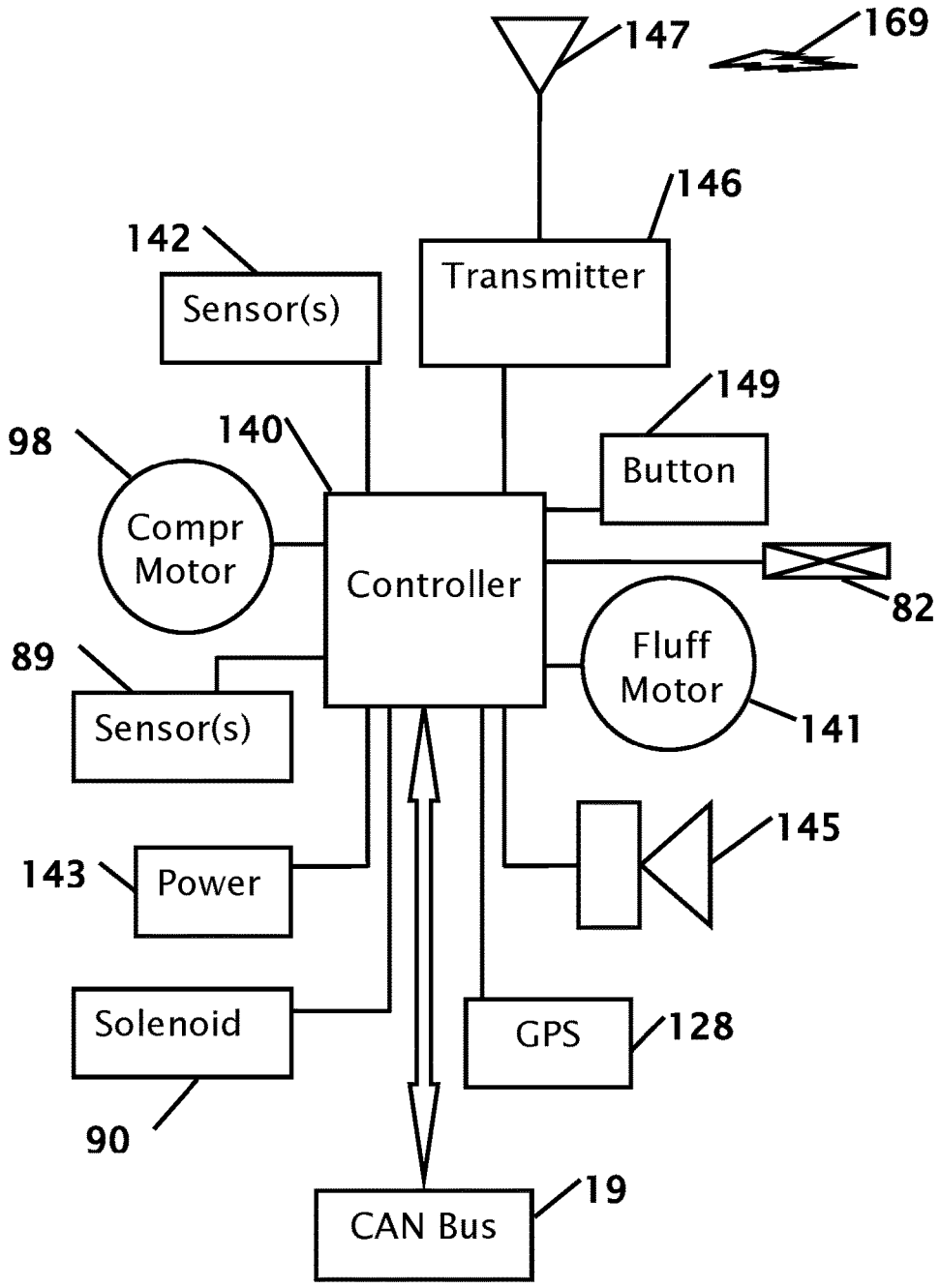
FIG. 4 shows block diagram of the electronic circuit for the control, drive and signaling mechanism.

FIG. 4 shows block diagram of the electronic circuit for the control, drive and activation mechanism. This block diagram is one contemplated configuration having a central controller 140. The central controller 140 may include electronics that periodically activate the motor 141 to turn the fluffer for a temporal period of time. One or more sensors 142 can detect information regarding the extinguisher like internal pressure. If the pressure is too low, the controller 140 can activate the compressor 98 to increase the pressure in the fire extinguisher. Additional sensors 89 can be distributed around a vehicle or can utilize information from existing vehicle sensors to determine if an elevated temperature exists or an Impact has occurred to proactively expel fire retardant material that requires activation of the fire extinguisher.

In one contemplated embodiment an audible alarm 145 can indicate a problem with the extinguisher such as over/under pressure, activation. In still another contemplated embodiment the extinguisher can have a wireless 147 communication transmitter/receiver 146 whereby the status of the extinguisher and sensors can be determined distally from the extinguisher, and this also allows for the extinguisher to be activated remotely from the vehicle. This can be useful when the vehicle is too hot to approach, but a fire truck or other assisting parties can activate the extinguisher at a distance from the vehicle. The housing can include environmental sensors 142 that can transmit local environmental conditions, such as but not limited to, temperature, humidity, CO2, SO2, CO, pressure, temperature and GPS 128, longitude, latitude, elevation and address location. This transmitted data 169 can be received 167 by a receiver unit 166 on or in a PC, laptop, tablet, cell phone or similar device 160 to provide a drawing on a display 168 of one or more fire extinguishers in a facility. The wireless data 169 can be sent using various type of transmission including, but not limited to, Bluetooth, Wi-Fi, LAN, WAN, FM and cellular networks.

Another sensor or button 149 is used to manually activate the motor or the test the device. The extinguisher can also be activated manually. In the preferred embodiment the power 143 is supplied by power from the electrical system of the vehicle, but can also have one or more batteries to operate the extinguisher in the event of an electrical failure in the vehicle. The extinguisher can be connected into the communications system of the vehicle CAN Bus 19 that provides many sensors for systems within the vehicle.

The controller 140 can control one or more valves 82 that directs flow through the manifold to one or more particular areas of the vehicle. The solenoid 90 operates the activation of the fire extinguisher.

Thus, specific embodiments of an improved fire extinguisher have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. A self-fluffing fire extinguishing delivery system comprising:

a chamber having an exterior and an interior wherein said interior if said chamber contains a powdered fire suppressing media;

at least one appendage located in said interior of said chamber;

said appendage is secured to a fluffing tube shaft that extends from within said chamber to an exterior of said chamber;

said appendage is articulatable from the exterior of the chamber to condition the powdered fire suppression media within the chamber, and said interior of said chamber is connected through said fluffing shaft tube to the at least one emission port.

2. The self-fluffing fire extinguishing delivery system according to claim 1, further includes a manifold between said fluffing shaft tube and said at least one emission port.

3. The self-fluffing fire extinguishing delivery system according to claim 1, wherein said conditioning of the powdered fire suppression media agitates, fluffs, turns, disturbers, stirs, ruffles, and or alters the condition of the media to allow the media to maintain a powder consistency.

4. The self-fluffing fire extinguishing delivery system according to claim 1, further includes a pressurized gas canister that pressurizes said chamber.

5. The self-fluffing fire extinguishing delivery system according to claim 2, wherein said manifold extends to at least an engine compartment of a vehicle whereby said powdered fire suppressing media flows from said interior of said chamber through said manifold to said engine compartment.

6. The self-fluffing fire extinguishing delivery system according to claim 1, wherein said chamber is initially pressurized, pressurized by an external pressurized canister.

7. The self-fluffing fire extinguishing delivery system according to claim 1, wherein said appendage is articulated with a rotary actuator that is connected to said appendage.

8. The self-fluffing fire extinguishing delivery system according to claim 7, wherein said rotary actuator is an electric motor or a pneumatic motor.

9. The self-fluffing fire extinguishing delivery system according to claim 8, wherein said rotary actuator is activated by at least a timed interval or an event.

* * * * *